United States Patent [19]

Gora

[11] Patent Number: 4,663,803

[45] Date of Patent: May 12, 1987

[54] SECURITY HINGE JOINT WITH SEPARATE HINGE PIN

[75] Inventor: Paul R. Gora, Hartland, Wis.

[73] Assignee: Menasha Corporation, Neenah, Wis.

[21] Appl. No.: 852,357

[22] Filed: Apr. 15, 1986

[51] Int. Cl.[4] ..... E05D 7/10

[52] U.S. Cl. ..... 16/266; 16/380; 220/337; 220/338; 220/340

[58] Field of Search ..... 16/229, 257, 259, 262, 16/266, 378, 379, 380; 220/337, 338, 340, 341

[56] References Cited

U.S. PATENT DOCUMENTS

| | | | |
|---|---|---|---|
| 3,295,714 | 1/1967 | Di Addario | 220/31 |
| 3,463,345 | 8/1969 | Bockenstette | 220/29 |
| 4,005,800 | 2/1977 | Schurman | 220/337 |
| 4,161,261 | 7/1979 | Frater | 220/337 |
| 4,349,121 | 9/1982 | Lafferty | 220/341 |
| 4,466,541 | 8/1984 | Tabler et al. | 206/506 |
| 4,469,240 | 9/1984 | Lathrop | 220/343 |
| 4,470,517 | 9/1984 | Carrier | 220/341 |
| 4,558,799 | 12/1985 | Hammond | 220/337 X |

FOREIGN PATENT DOCUMENTS

| | | | |
|---|---|---|---|
| 959437 | 12/1964 | Canada . | |
| 703687 | 2/1965 | Canada . | |
| 1019684 | 10/1977 | Canada . | |
| 1133859 | 10/1982 | Canada . | |
| 3414401 | 10/1985 | Fed. Rep. of Germany | 16/266 |

*Primary Examiner*—Fred Silverberg

*Attorney, Agent, or Firm*—Quarles & Brady

[57] ABSTRACT

A security hinge joint includes a substantially planar, flexible first member, including first and second blind hinge eyes. A second member is pivotable relative to the first member and includes at least one second open hinge eye which lies between the blind hinge eyes. A hinge pin extends through the second open hinge eye and into the first blind hinge eye. The first blind hinge eye wraps around the end of the hinge pin, enclosing the bottom of the pin when the joint is in a closed position, and is interrupted to define a lead-in slot through which the hinge pin can pass. For insertion or removal of the hinge pin, one end of the first member must be flexed out of the plane of the first member.

7 Claims, 10 Drawing Figures

FIG. 1
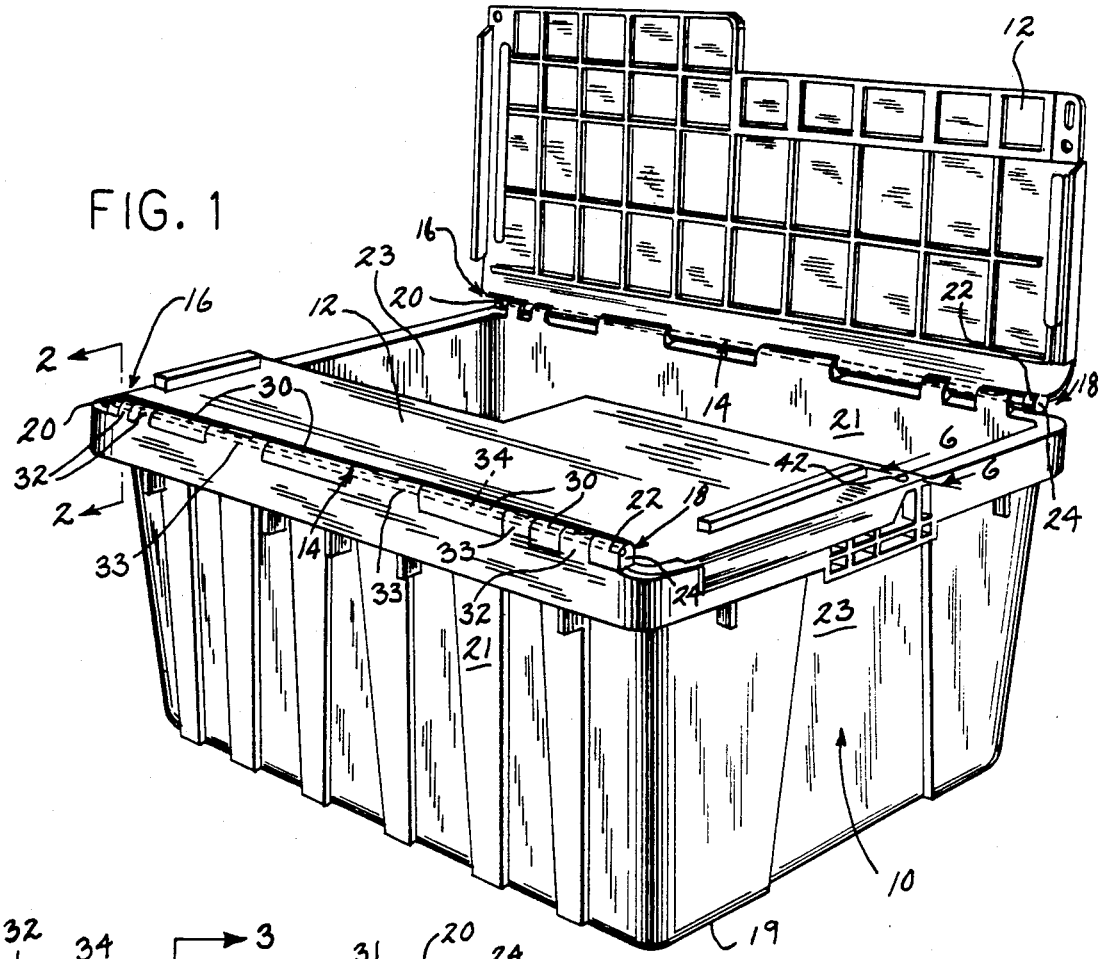
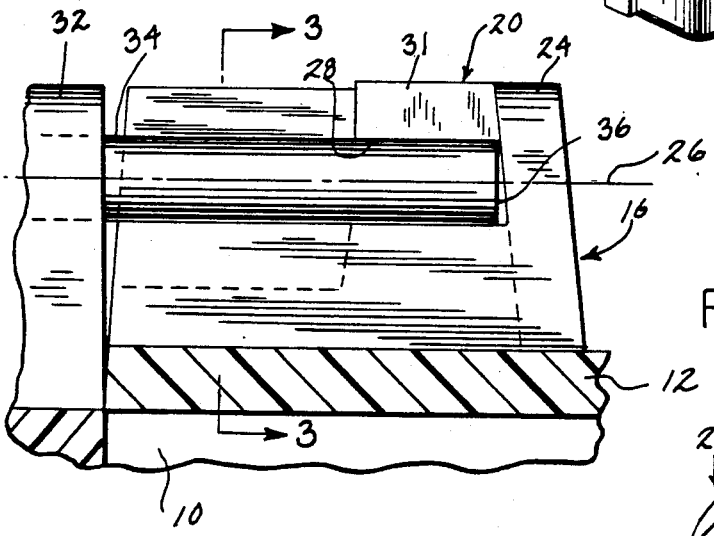
FIG. 2
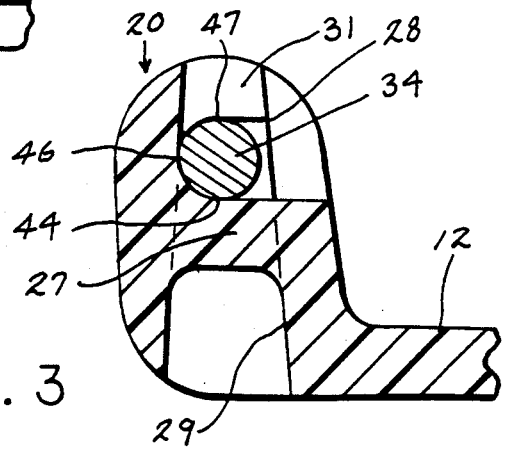
FIG. 3

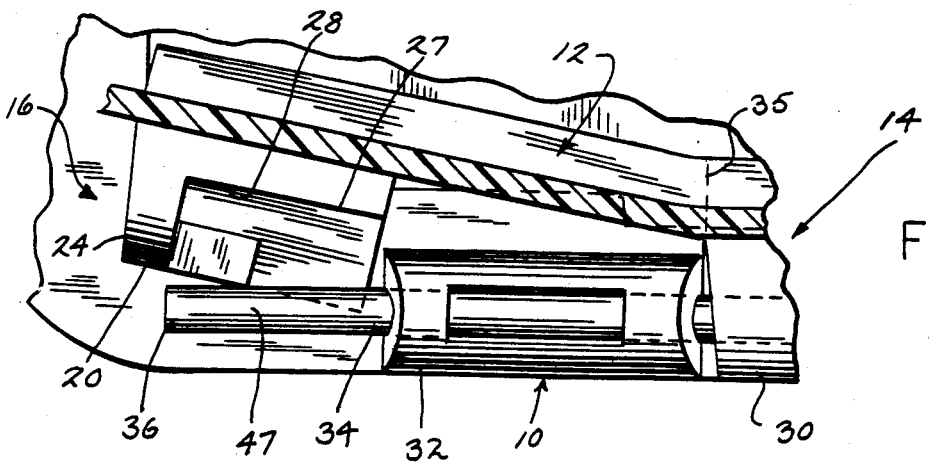
FIG. 7
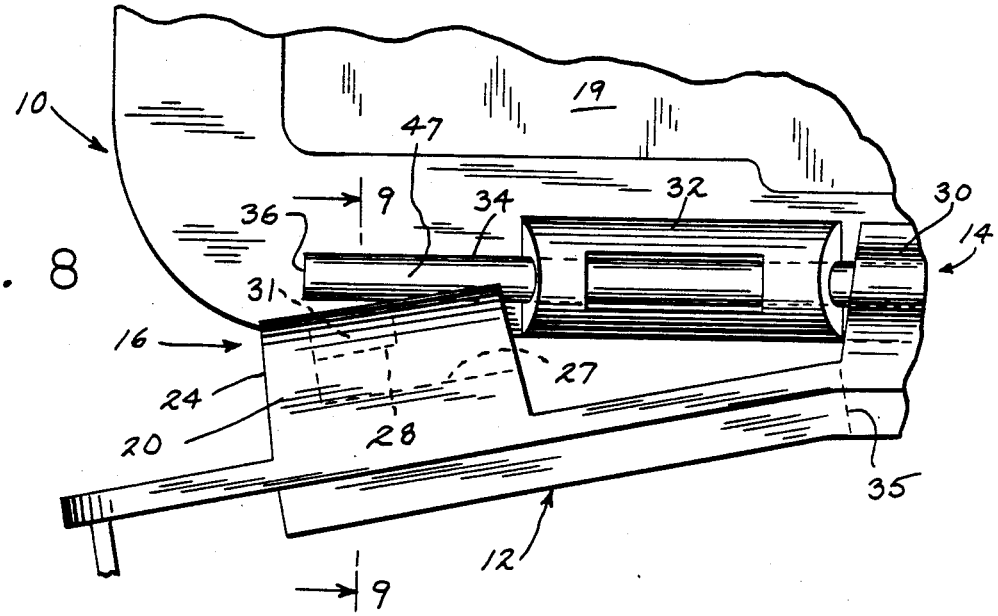
FIG. 8
FIG. 9
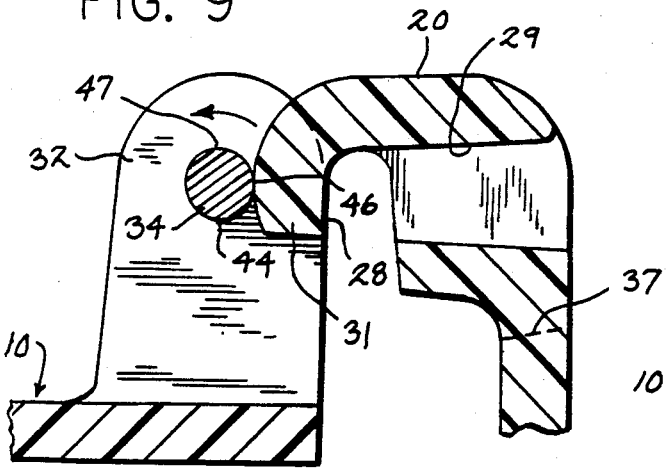
FIG. 10
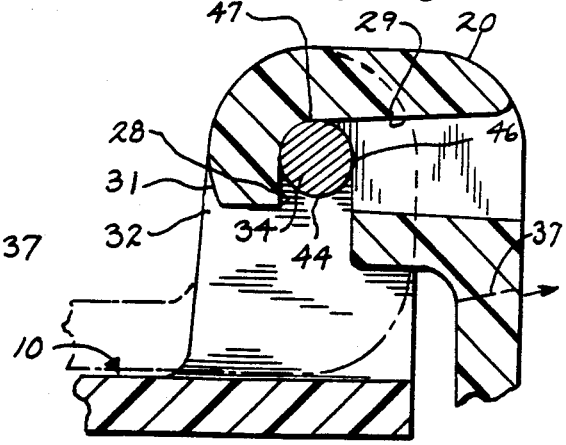

SECURITY HINGE JOINT WITH SEPARATE HINGE PIN

BACKGROUND OF THE INVENTION

The present invention relates to a security hinge joint which may be used for containers or in other applications in which it is desirable to reduce the problem of tampering with the hinge joint.

Many different hinge arrangements have been used in the past. A common hinge arrangement for containers is shown in U.S. Pat. No. 4,161,261, issued July 17, 1979 to James Frater. This patent shows the use of a "gooseneck" type of hinge pin. All the hinge eyes are open (generally cylindrical with open ends). One end of the hinge pin has a "gooseneck" shape. The pin can be inserted from either end of the hinge, passing through all the hinge eyes, and is retained when the gooseneck portion snaps into a recess or hole in one of the hinge eyes.

While the use of a single, rigid hinge pin extending through all the hinge eyes provides important strength and rigidity to the hinge joint, several problems have been encountered with the gooseneck design. One problem is that, if the gooseneck portion is accidentally inserted out of its proper orientation, the gooseneck portion does not fit into its recess, and the hinge wire can work itself free through one of the open ends of the hinge. Second, in order to install the hinge pin, the gooseneck portion must be driven through a hinge eye in which it has an interference fit. Forcing the gooseneck through the hinge eye sometimes causes the hinge to break. Finally, it is possible to open a container with the gooseneck type of hinge simply by driving the pin out through one of the open hinge ends, pilfering the goods inside the container, and then replacing the hinge pin so that it is impossible to tell from the outside that the container has been tampered with.

SUMMARY OF THE INVENTION

The present invention takes advantage of prior designs in which a single, rigid hinge pin extends through several hinge eyes in a flexible member for strength and rigidity of the hinge joint. It takes advantage of the normal flexibility of the hinge member and provides a hinge with blind (closed) ends so that the hinge pin cannot be removed by driving it through either of the ends. The hinge of the present design can be assembled or disassembled only in an open position.

The hinge of the present invention is assembled or disassembled by flexing the cover of the container to insert or remove the hinge pin. It is almost impossible to flex the cover within the plane of the cover, so the flexure used for assembly and disassembly must be some flexure of a portion of the cover out of the plane of the cover. Due to the design of the blind hinge eyes at each end of the hinge, the cover must flex so that one of the blind hinge eyes moves out of line from the rest of the hinge joint in order to insert or remove the hinge pin. When the cover is closed, the only ways the end of the cover could flex out of the plane of the cover for removal of the hinge pin are upward, away from the container, or downward, toward the container. However, in the closed position, the container contacts the bottom of the cover so as to prevent the blind hinge eye from flexing downward. The blind hinge eyes wrap around the bottom of the hinge pin when the cover is in the closed position, thereby preventing the blind hinge eye from flexing upward. Thus, the flexure required for assembly or disassembly of the hinge cannot be done in the closed position and can only be accomplished when the cover is in an open position, when the container does not interfere with flexure of the cover. Therefore, it is not possible to disassemble the joint in the closed position, pilfer the contents of the container, and then reassemble the joint without damaging the hinge joint in a noticeable way (e.g., by breaking one or more of the hinge eyes).

In addition, by providing a straight hinge pin, there is no need to orient the pin in any particular direction as is required with the gooseneck pin, and, by eliminating the gooseneck, the failure of the hinge during insertion of the pin due to forces applied by the gooseneck portion is also eliminated.

The present invention provides a security hinge joint, comprising: a substantially planar, flexible first member, including first and second hinge ends, the hinge ends having first and second blind hinge eyes, respectively; and a second member, moveable relative to the first member and including at least one second open hinge eye which is axially aligned with and lies between the first and second blind hinge eyes; and a separate hinge pin, extending through the second open hinge eye, and into the first blind hinge eye; wherein the first blind hinge eye wraps around the hinge pin, enclosing the bottom of the hinge pin when the joint is in the closed position, and is interrupted to define a lead-in slot through which the hinge pin can pass, and wherein, for insertion or removal of said hinge pin, a portion of said first member must be flexed out of the plane of the first member.

BRIEF DESCRIPTION OF THE DRAWINGS

FIG. 1 is a perspective view of a container and lid sections including the security hinge joint of the present invention;

FIG. 2 is a view taken along the section 2—2 of FIG. 1;

FIG. 3 is a view taken along the section 3—3 of FIG. 2;

FIG. 7 is a view along the section 7—7 of FIG. 4 showing the lid section in the flexed position.

FIG. 8 is the same view as FIG. 7 but with the lid section pivoted open an additional 180° beyond its position in FIG. 7;

FIG. 9 is a view along the section 9—9 of FIG. 8; and

FIG. 10 shows the lid section and container of FIG. 9 when the lid has returned to its flat, unflexed position.

DESCRIPTION OF THE PREFERRED EMBODIMENT

Figure 4:
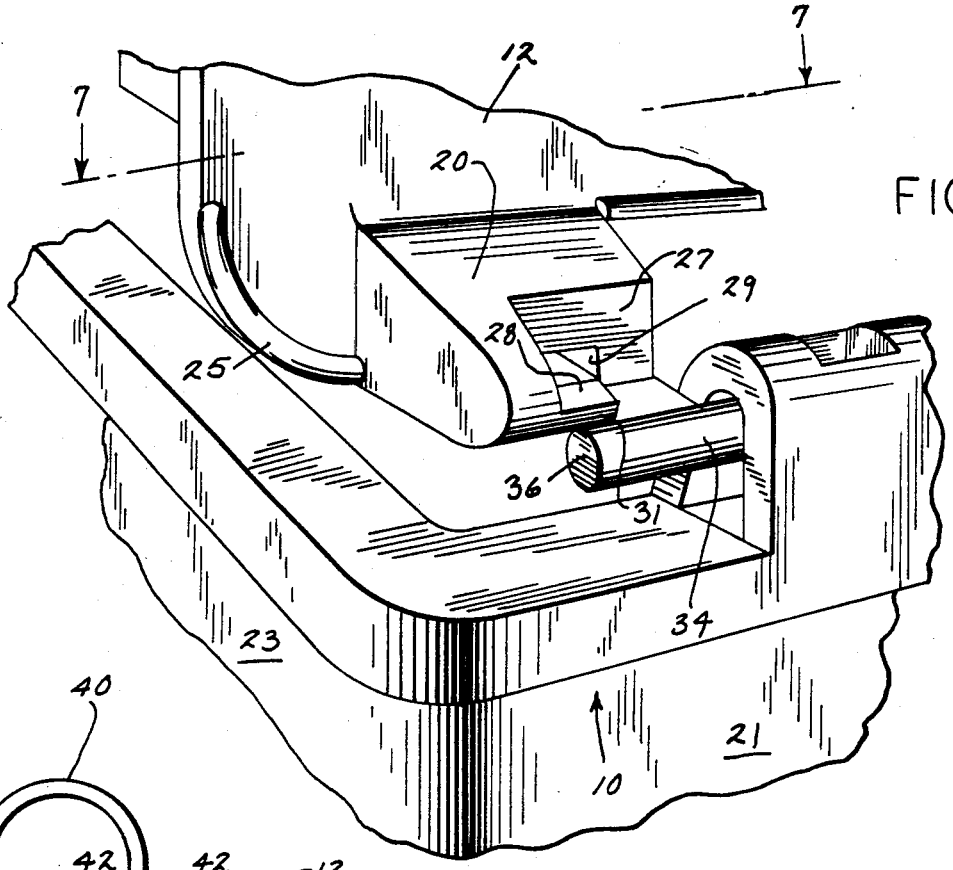
FIG. 4 is a broken away perspective view from the back or outside of the hinge joint with the lid section open upward and the corner of the lid flexed inward, out of the plane of the lid.
Figure 5:
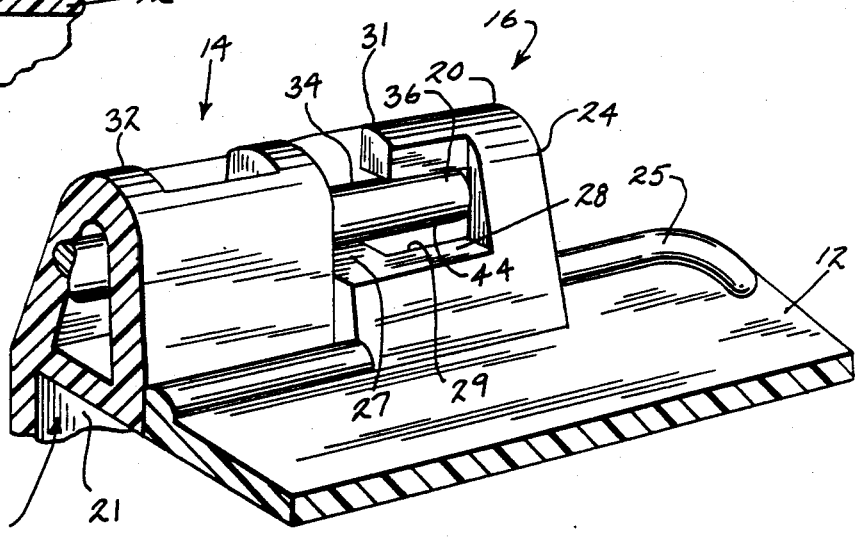
FIG. 5 is a broken away perspective view of the front or inside of the hinge joint with the lid section closed.

FIG. 1 shows a container 10 having two flexible lid sections 12. Each of the lid sections 12 is rotatably joined to one of the walls of the container 10 by means of a security hinge joint 14. Each lid section or first member 12 is substantially planar and has first and second hinge ends 16, 18, respectively. The first hinge end 16 has a first blind hinge eye 20, and the second hinge end 18 has a second blind hinge eye 22. (A blind hinge eye has a closed end, while an open hinge eye is open at both ends.) As can be seen more clearly in FIGS. 2–5, and 7–10, the first and second blind hinge eyes 20, 22 include a closed end 24 and a lead-in slot 28. The blind hinge eyes 20, 22 wrap around the bottom 44, back (or outside) 46, and top 47 of the hinge pin 34 when the first member 12 is in the closed position as shown in FIGS. 3 and 5, and each blind hinge eye 20, 22 is interrupted to define a lead-in slot 28. As shown in these figures, the lead-in slot 28 is at least as wide as the diameter of the hinge pin 34 in order to permit the pin to pass through the slot 28. Alternatively, the slot could be somewhat smaller than the pin diameter as long as the material of the blind eye is flexible enough that the slot can open up to permit the pin to pass through.

The blind eyes 20, 22 also define an opening 29 which, when the lid section 12 is in the closed position, begins at the bottom 44 of the pin 34 and extends completely through the blind eye 20 or 22. The opening 29 lies between the closed end 24 and the portion 27 of the blind eye 20, 22 which wraps around the bottom 44 of the pin 34. The opening 29 is directly below and has approximately the same dimensions as the portion 31 of the blind hinge eye 20, 22 which wraps around the top 47 of the pin 34. The opening 29 is made for ease in molding the part and does not affect the functioning of the lead-in slot 28.

Between the first and second blind eyes 20, 22, are several first open hinge eyes 30 which are integral with the first member 12 and are axially aligned with the first and second blind eyes 20, 22 along the hinge axis 26 (shown in FIG. 2). The lid section 12 also includes reinforced corners 25 (shown in FIG. 4).

The container or second member 10 includes a plurality of second open hinge eyes 32, 33 which, when the hinge joint 14 is assembled, are coaxial with the eyes 20, 22, 30 on the first member 12 and lie between the eyes of the first member. The second open hinge eye 32 lies between the first blind eye 20 and one of the first open eyes 30 and completely encircles the hinge pin 34 so that the pin 34 can only enter or leave the open hinge eye 32 by moving in an axial direction.

A single hinge pin 34 extends through all the open hinge eyes 30, 32, 33 and into the first and second blind hinge eyes 20, 22 to join the first and second members 12, 10 together. The single hinge pin 34 provides rigidity to the joint even though the first member 12 is made of a relatively flexible material, such as a polymeric material. It is possible to make the hinge pin in two or more abutting sections, each section extending through a plurality of hinge eyes, but a single pin 34 is preferred.

The container 10 also includes four upright walls—two side walls 23, and two faces 21. The upright walls 21, 23 are approximately at right angles to their respective adjacent walls and are joined at their base by a bottom wall 19. The open hinge eyes 30, 32, 33 are axially aligned along the top edge of the walls 21. The open top of the container 10 is closed when the lid sections 12 are in the closed position.

For assembly of the hinge joint 14, the open and closed hinge eyes 30, 32, 33, 20, 22 are aligned while the lid section 12 and hinge joint 14 are in an open position, preferably a vertical position with the eyes 20, 22, 30 at the bottom. The first end 16 of the lid section 12 is flexed out of the plane of the lid section to flex the first blind eye 20 away from the rest of the hinge joint 14 (as shown in FIGS. 4 and 7). The flexing actually occurs approximately along the section line 35. The line 35 runs from the hinge edge of the lid section 12 to the free edge of the lid section just outside the endmost first open hinge eye 30 as shown in FIGS. 7 and 8. The hinge pin 34 is inserted lengthwise through the open hinge eyes 30, 32, 33 and into the second blind hinge eye 22 until one end 36 of the hinge pin abuts the closed end 24 of the second blind hinge eye 22. Then the lid section 12 is rotated outward 180° until it lies against the outside of the container face 21 as shown in FIGS. 8 and 9. The first blind eye 20 of the lid section 12 is then flexed outward by flexing along the section line 37. The section line 37 runs cross-wise (perpendicular to the first section line 35) and is just inside the blind hinge eye 20 as shown in FIG. 9. The flexure along the line 37 permits the blind eye 20 to extend around the pin 34 following the arrow shown in FIG. 9 so that, when the end 16 is released, it hooks around the pin 34 as shown in FIG. 10, so that the other end 36 of the hinge pin 34 enters the lead-in slot 28 of the first blind hinge eye 20. The pin 34 is then in position in all the hinge eyes, with the ends 36 of the hinge pin 34 loosely abutting the closed ends 24 of their respective blind eyes 20, 22. It will be noted that, because both closed eyes 20, 22 include the lead-in slot 28, the pin could alternatively be inserted from the second end 18 in the same manner as it was inserted from the first end 16.

Figure 6:
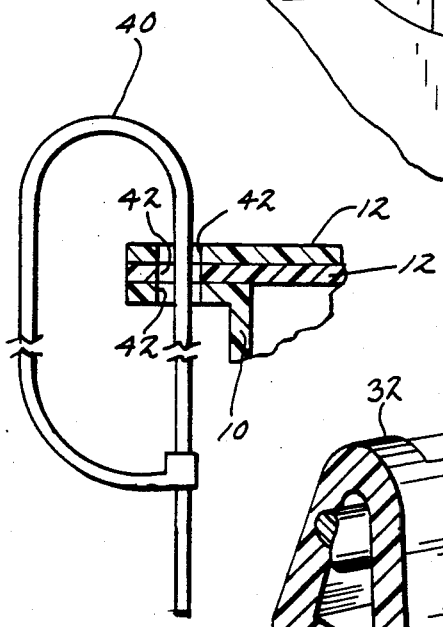
FIG. 6 is a view along the section 6—6 of FIG. 1 showing the lock which secures the lid in the closed position.

The cover 12 is then rotated onto the container 10 following the arrow in FIG. 10 until it reaches the closed position as shown in FIGS. 2, 3 and 5, and it is then secured in the closed position by means of a lock 40 (shown in FIG. 6) passing through the holes 42 in the lid sections 12 and container 10. As shown in FIG. 6, the two lid sections 12 overlap in the central portion of the container 10, so that the lock 40 passes through holes 42 in each lid section 12 and in the container 10.

Portion 27 of the blind eyes 20, 22 wraps around the bottom 44 of the hinge pin 34 when the lid section 12 is closed. The blind hinge eyes 20, 22 also wrap around the back 46 of the hinge pin 34, and portion 31 wraps around the top 47 of the hinge pin 34 when the lid section 12 is closed. It is important that the portion 31 wraps around the top 47 of the hinge pin in order to prevent the pin 34 from being accidentally bumped out of the blind eye 20 or 22 when the lid section 12 is in the fully open position shown in FIG. 10.

In order to disassemble the hinge joint 14 when the lid section 12 is in the closed position, one end of the lid section 12 would have to flex out of the plane of the lid section 12, so that one of the hinge pin ends 36 could move out through its respective lead-in slot 28. However, when the lid section 12 is in the closed position, the container 10 contacts the bottom of the lid section 12 and prevents downward flexure of the lid section 12 relative to the container 10. Because the blind hinge eyes 20, 22 wrap around the bottom 44 of the hinge pin 34, they prevent the ends of the lid section 12 from flexing upward, away from the rest of the hinge joint 14. Therefore, the hinge joint 14 cannot be disassembled in the closed position. When the lock 40 is removed, and the cover section 12 is again opened, the cover section 12 swings free of those restraints of the container 10 and can again be flexed at either end 16, 18 for removal of the hinge pin 34.

Thus, the security hinge joint design of the present invention takes advantage of the strength and rigidity provided to a flexible cover section by a separate hinge pin extending through several hinge eyes, while avoiding previous problems involved in installing and retaining those hinge pins. The hinge of the present invention takes advantage of the flexibility of the cover section to provide a joint that can easily be assembled and disassembled in an open position. In addition, the present hinge design provides a hinge that cannot be tampered with in the closed position without causing noticeable damage to the hinge eyes.

It is possible that the container wall could be the first member, having the blind hinge eyes, and the lid section could be the second member, if the container wall were able to flex enough for insertion and removal of the pin.

It will be obvious to those skilled in the art that modifications may be made to the embodiment described above without departing from the scope of the present invention.

What is claimed is:

1. A security hinge joint, comprising:

a substantially planar, flexible first member, including first and second hinge ends, said hinge ends haivng first and second blind hinge eyes, respectively;

a second member, pivotable relative to said first member so as to define a closed position and at least one open positon and including at least one open hinge eye which is axially aligned with and lies between said blind hinge eyes;

a separate hinge pin, extending through said open hinge eye and into said first and second blind hinge eyes;

wherein said first blind hinge eye wraps around said hinge pin, enclosing the bottom of said pin when said second member is in said closed position, and is interrupted to define a lead-in slot through which said hinge pin can pass, and wherein, for insertion or removal of said hinge pin from the first blind eye, one end of said first member must be flexed out of the plane of said first member; and wherein, when the second member is in the closed position, said second member prevents said first member from flexing toward said second member, so that said first member cannot flex for removal of said hinge pin through said lead-in slot.

2. A security hinge joint as recited in claim 1, wherein said hinge pin also extends into said second blind hinge eye, and wherein said hinge pin is completely encircled by said open hinge eye.

3. A security hinge joint, comprising:

a flexible first member, including first and second hinge ends, said hinge ends having first and second blind hinge eyes, respectively, and including at least one first open hinge eye axially aligned with and lying between said blind hinge eyes;

a second member, pivotable relative to said first member so as to define a closed position and at least one open position, and including at least one second open hinge eye which is axially aligned with and lies between said first blind hinge eye and said first open hinge eye; and a separate hinge pin, extending into said first open hinge eye, through said second open hinge eye and into said first blind hinge eye;

wherein said first blind hinge eye wraps part-way around said hinge pin, wrapping around the bottom of said pin when said second member is in said closed position, to leave a lead-in slot through which said hinge pin can pass upon flexing of the first member; and wherein, when the second member is in the closed position, said second member prevents said first member from flexing toward said second member, so that said first member cannot flex for removal of said hinge pin through said lead-in slot.

4. A security hinge joint as recited in claim 1 or 3, wherein said first blind hinge eye also wraps around the top of said hinge pin when said hinge joint is in the closed position.

5. A security hinge joint as recited in claim 4, wherein said first blind hinge eye also wraps around the back of said hinge pin when said hinge joint is in the closed position.

6. A security hinge joint as recited in claim 5, and further comprising means for locking said hinge joint in the closed position.

7. A security hinge joint as recited in claim 6, wherein said first member is a lid section and said second member is a container.

* * * * *